US009949882B2

(12) United States Patent
Holladay

(10) Patent No.: US 9,949,882 B2
(45) Date of Patent: Apr. 24, 2018

(54) TAPERED OPERATING ROOM TABLE PAD

(71) Applicant: Prime Medical, LLC, Knoxville, TN (US)

(72) Inventor: David Holladay, Knoxville, TN (US)

(73) Assignee: Prime Medical, LLC, Knoxville, TN (US)

( * ) Notice: Subject to any disclaimer, the term of this patent is extended or adjusted under 35 U.S.C. 154(b) by 0 days.

(21) Appl. No.: 15/330,817

(22) Filed: Nov. 7, 2016

(65) Prior Publication Data

US 2017/0189255 A1 Jul. 6, 2017

Related U.S. Application Data

(63) Continuation-in-part of application No. 14/292,057, filed on May 30, 2014, now abandoned.

(51) Int. Cl.
*A61G 13/12* (2006.01)
*A47C 27/08* (2006.01)

(52) U.S. Cl.
CPC ..... *A61G 13/126* (2013.01); *A47C 27/088* (2013.01); *A61G 13/121* (2013.01)

(58) Field of Classification Search
CPC ..... A61G 13/126; A61G 13/1225; A61G 13/122; A61G 13/121; A61G 13/123
See application file for complete search history.

(56) References Cited

U.S. PATENT DOCUMENTS 65,262 A * 5/1867 Ouroussof ..... A47G 9/062 5/420
2,835,902 A 5/1958 Fash
2,764,150 A 1/1966 Ettinger et al.
3,227,440 A 1/1966 Scott
3,268,922 A * 8/1966 Moxley ..... A47C 17/82 224/235
3,780,387 A 12/1973 Propst
4,193,150 A * 3/1980 Vineberg ..... A47C 20/027 297/DIG. 1
4,275,473 A * 6/1981 Poirier ..... A47C 1/146 441/128
4,316,298 A * 2/1982 Russo ..... A47C 27/001 5/411

(Continued)

FOREIGN PATENT DOCUMENTS

EP 0977517 7/2005
EP 1635757 6/2010

(Continued)

OTHER PUBLICATIONS

J. Klauschie, MD, et al "Use of Anti-Skid Material and Patient-Positioning to Prevent . . . ", The Journal of Minimally Invasive Gynecology, vol. 17 No. 4, p. 504-507, Aug. 2010.

(Continued)

*Primary Examiner* — Eric J Kurilla
(74) *Attorney, Agent, or Firm* — Pitts & Lake, P.C.

(57) ABSTRACT

A surgical pad to support a patient on an operating room table, including a gel-infused polyurethane visco-elastic foam configured to support a patient on an operating room table, and an optional perineal cut-out to permit access to the patient's perineum when the patient is lying in a supine position on the surgical pad, and methods of making and using such a surgical pad during surgery.

5 Claims, 8 Drawing Sheets

(56) References Cited

U.S. PATENT DOCUMENTS 4,329,747 A * 5/1982 Russell ..... A47G 9/062 5/420
4,336,621 A * 6/1982 Schwartz ..... A47C 27/001 5/411
4,450,193 A * 5/1984 Staebler ..... A47C 9/027 428/102
4,601,076 A * 7/1986 Knobeloch ..... A47C 17/70 5/413 R
4,678,171 A * 7/1987 Sanders ..... A61G 13/12 5/618
4,840,362 A 6/1989 Bremer et al.
4,884,304 A 12/1989 Elkins
5,010,610 A * 4/1991 Ackley ..... A47C 27/14 5/420
5,054,142 A 10/1991 Owens
5,210,891 A * 5/1993 Avital ..... A45C 3/10 224/156
5,269,035 A 12/1993 Hartunian
5,291,625 A * 3/1994 Leslie ..... A47C 27/081 5/420
5,306,231 A 4/1994 Cullum et al.
5,343,876 A * 9/1994 Rogers ..... A47C 7/022 128/845
5,362,302 A 11/1994 Jensen et al.
5,448,790 A 9/1995 Saro et al.
5,486,206 A 1/1996 Avery
5,661,860 A 9/1997 Heitz
5,720,057 A * 2/1998 Duncan ..... A47C 27/001 5/420
5,837,002 A 11/1998 Augustine et al.
5,893,183 A 4/1999 Bechtold, Jr.
6,098,378 A * 8/2000 Wyatt ..... B65B 63/024 53/118
6,237,172 B1 5/2001 Morgan, Sr.
6,401,283 B2 6/2002 Thomas et al.
6,484,334 B1 11/2002 Bordrs et al.
6,516,483 B1 2/2003 Van Steerburg
6,541,094 B1 4/2003 Landvik
6,640,359 B1 * 11/2003 Alane ..... A47G 27/0237 5/417
6,653,363 B1 11/2003 Tursi, Jr. et al.
6,701,558 B2 3/2004 VanSteenburg
6,817,363 B2 11/2004 Biondo et al.
6,904,631 B2 6/2005 Yrzalik et al.
6,933,469 B2 8/2005 Ellis et al.
7,007,322 B2 * 3/2006 Alane ..... A47G 27/0237 5/417
7,179,255 B2 2/2007 Lettice et al.
7,240,384 B2 7/2007 DuDonis
7,461,894 B2 * 12/2008 Leeds ..... A45C 3/00 297/219.1
7,555,794 B2 7/2009 Zelnik et al.
7,603,730 B2 10/2009 Zelnik
7,621,005 B1 * 11/2009 Harvey ..... A45C 11/20 5/419
7,731,282 B2 6/2010 Leeds
7,731,283 B2 6/2010 Leeds
7,757,318 B2 7/2010 Poulos et al.
7,789,461 B2 9/2010 Leeds
7,971,298 B2 7/2011 Kobuβ et al.
8,011,045 B2 9/2011 Skripps
8,342,603 B2 * 1/2013 Leeds ..... A47C 7/021 297/219.1
8,464,720 B1 6/2013 Pigazzi et al.
8,511,314 B2 8/2013 Pigazzi et al.
8,512,854 B2 * 8/2013 Fox ..... A43B 1/0072 428/316.6
8,539,621 B2 9/2013 West
8,650,687 B2 * 2/2014 Klerer ..... B65B 63/02 5/699
8,756,733 B2 6/2014 Hughes et al.
8,759,235 B2 * 6/2014 Sabry ..... A47G 27/0237 428/156
D774,328 S * 12/2016 Shamash ..... D6/596
2002/0083527 A1 * 7/2002 Ruehl ..... A61G 7/05 5/600
2002/0114918 A1 * 8/2002 Mossbeck ..... A47C 27/122 428/90
2004/0250346 A1 * 12/2004 Vasishth ..... A63B 21/4037 5/417
2005/0187598 A1 8/2005 Shimizu et al.
2005/0210595 A1 9/2005 D Stasio et al.
2006/0016016 A1 1/2006 Hornbach
2007/0163048 A1 * 7/2007 Kimball ..... A47C 20/021 5/632
2008/0052834 A1 * 3/2008 Hill ..... A61G 13/12 5/655.9
2008/0078028 A1 * 4/2008 McMahan ..... A47G 27/0231 5/420
2008/0178390 A1 7/2008 DuDonis
2009/0142551 A1 6/2009 Fox et al.
2009/0276957 A1 * 11/2009 Boitet-Ball ..... A47G 27/0237 5/420
2009/0307846 A1 * 12/2009 Eura ..... A47C 7/383 5/636
2010/0275377 A1 11/2010 West
2010/0281617 A1 11/2010 Brun
2011/0034887 A1 2/2011 Forden et al.
2011/0047706 A1 3/2011 Hiebert
2012/0015151 A1 1/2012 Pearce et al.
2012/0079662 A1 * 4/2012 Dzioba ..... A61G 7/05776 5/713
2012/0255124 A1 10/2012 West
2014/0366271 A1 * 12/2014 Marshall ..... A61F 5/3776 5/621
2015/0143635 A1 * 5/2015 Clark ..... A47G 9/08 5/636
2016/0304231 A1 * 10/2016 Corodemus ..... B65B 63/02

FOREIGN PATENT DOCUMENTS

GB 2484885 5/2012
WO WO2013/106426 7/2013

OTHER PUBLICATIONS

Patent Cooperation Treaty; Int'l Search Report; Form PCT/ISA/220; dated Dec. 3, 2014.
Federal Aviation Administration; Aircraft Certi. Division; Flammability Requirements for Aircraft Seat Cushions Section 25.853-1.17; https://www.fire,tc.faa.gov/pdf/25-856.pdf.
Meridian Medical; Surgical Positioners Brochure, Apr. 3, 2012.
Patent Cooperation Treaty; International Preliminary Report on Patentability; Form PCT/IB/373; dated Dec. 3, 2014.

* cited by examiner

TAPERED OPERATING ROOM TABLE PAD

CROSS-REFERENCE TO RELATED APPLICATIONS

This application is a continuation-in-part of U.S. patent application Ser. No. 14/292,057, filed May 30, 2014, the disclosure of which is hereby incorporated by reference herein in its entirety.

FIELD OF INVENTION

The present general inventive concept relates to a patient positioning pad to support a patient on an operating room table during a medical procedure, and methods of making and using such a pad.

BACKGROUND OF THE INVENTION

It is known to provide surface covers for operating tables to support a patient on the operating table during a medical procedure. Efforts regarding such devices have led to continuing developments to improve their versatility, practicality, functionality, efficiency, efficacy, and convenience of use.

BRIEF SUMMARY

Embodiments of the present general inventive concept provide a surgical pad including a gel-infused foam pad configured in shape and size to support a patient on an operating room table, the gel-infused foam pad having characteristics which improve the versatility, practicality, functionality, efficiency, efficacy, and convenience of use.

Example embodiments of the present general inventive concept can be achieved by providing a surgical pad to support a patient on an operating room table, including a foam body configured to support a patient on an operating room table, the foam body having a first thickness at a first end and a second thickness at a second end where the first thickness is less than the second thickness, and a perineal cut-out at the first end defining an arcuate shape extending through the first thickness to permit access to the patient's perineum when the patient is lying in a supine position on the foam body.

The foam body can be formed of gel-infused polyurethane visco-elastic foam.

The perineal cut-out can define an arc less than 180 degrees in circumference, where the end points of the arc intersect the first surface in two locations to respectively define a pair of equidistant flats extending between the end points and opposing side edges of the foam body, respectively.

Example embodiments of the present general inventive concept can also be achieved by providing a tapered surgical pad to support a patient on an operating room table, including a foam pad formed of gel-infused polyurethane visco-elastic foam, the foam pad being configured to support a patient on an operating room table, the foam pad having a front surface, a back surface, a planar top surface, and a planar bottom surface, wherein the front surface defines a first thickness and the back surface defines a second thickness greater than the first thickness, the front surface and the back surface being substantially perpendicular to the bottom surface, and the top surface defining a first plane extending between the second thickness to the first thickness such that an angle between the first plane and a second plane defined by the back surface is an acute angle, and the angle between the first plane and the front surface is an obtuse angle, and a perineal cut-out at the front surface defining an arcuate shape extending through the front surface to permit access to the patient's perineum when the patient is lying in a supine position on the foam pad.

Example embodiments of the present general inventive concept may be achieved by providing a surgical pad including a foam pad configured to support a patient on an operating room table, the foam pad comprising a gel-infused polyurethane visco-elastic foam.

The foam pad may include a perineal cut-out to permit access to the patient's perineum when the patient is lying in a supine position on the foam pad.

The surgical pad may further include at least one strap configured to secure the foam pad to the table.

The foam pad may have a density of approximately 3.6 to 3.9 lbs/ft3.

The perineal cut-out may be approximately semi-circular in shape.

The cut-out may define an arc less than 180 degrees in circumference, the end points of the arc intersecting an end surface of the surgical pad in two locations to respectively define a pair of equidistant flats extending between the end points and side edges of the surgical pad, respectively.

Example embodiments of the present general inventive concept may also be achieved by providing a surgical pad for use in an electrosurgical system, the electrosurgical system including an electrosurgical device to deliver an electric current to a patient during an electrosurgical procedure, and a patient return electrode to return the electric current from the patient to the electrosurgical device when the patient is lying on the patient return electrode, the surgical pad comprising gel-infused material, the surgical pad being configured to be interposed between the patient return electrode and the patient during an electrosurgical procedure to create a low impedance path to conduct electric current from the patient to the patient return electrode during the electrosurgical procedure.

The surgical pad may be configured to be placed on the patient return electrode on a surgical procedure table to support the patient on the surgical procedure table in a steep Trendelenburg position.

The surgical pad may include an expanded cellular product including flame retardant polyurethane foam.

The surgical pad may further include a head receiving portion proximate an anterior end of the surgical pad.

The surgical pad may further include a recessed portion at a posterior end of the surgical pad that is configured to allow access to the patient's perineum when the patient is in a supine position.

The recessed portion may be arcuate and substantially centered on a width of the surgical pad.

The recessed portion may have end-points intersecting the posterior end of the surgical pad to define a pair of flat portions that extend from the end-points to respective corners of the posterior end.

Example embodiments of the present general inventive concept can be achieved by providing a method of using a surgical pad, where the surgical pad has been rolled into a substantially cylindrical article for storage or transportation. The method can include unrolling the surgical pad on an operating room table such that the surgical pad supports a patient in the Trendelenburg position. The surgical pad can be manufactured of a gel-infused polyurethane visco-elastic foam having substantially no memory such that the surgical pad assumes a flat shape on top of the operating room table immediately upon being unrolled from a stored, substantially cylindrical shape, the cylindrical shape being defined when the surgical pad is rolled upon itself from end-to-end on to form a substantially cylindrical article during storage of the surgical pad. The surgical pad can include a perineal cut-out to permit access to the patient's perineum when the patient is lying on the surgical pad in the Trendelenburg position.

Additional features and embodiments of the present general inventive concept will be set forth in part in the description which follows, and, in part, will be obvious from the description, or may be learned by practice of the present general inventive concept.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to various example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

In various example embodiments, the present general inventive concept provides a table pad configured to be used in various medical procedures, the table pad including a foam pad configured to support a patient on an operating room table, and including a gel-infused polyurethane and/or visco-elastic foam at least approximately one inch thick. As used herein, the term "gel-infused" foam refers to what is commonly known as 100% gel-infused polyurethane high density foam. This is distinguishable from foams that merely contain gel beads or other gel components added to the foam without having gel completely mixed into the material.

Figure 1:
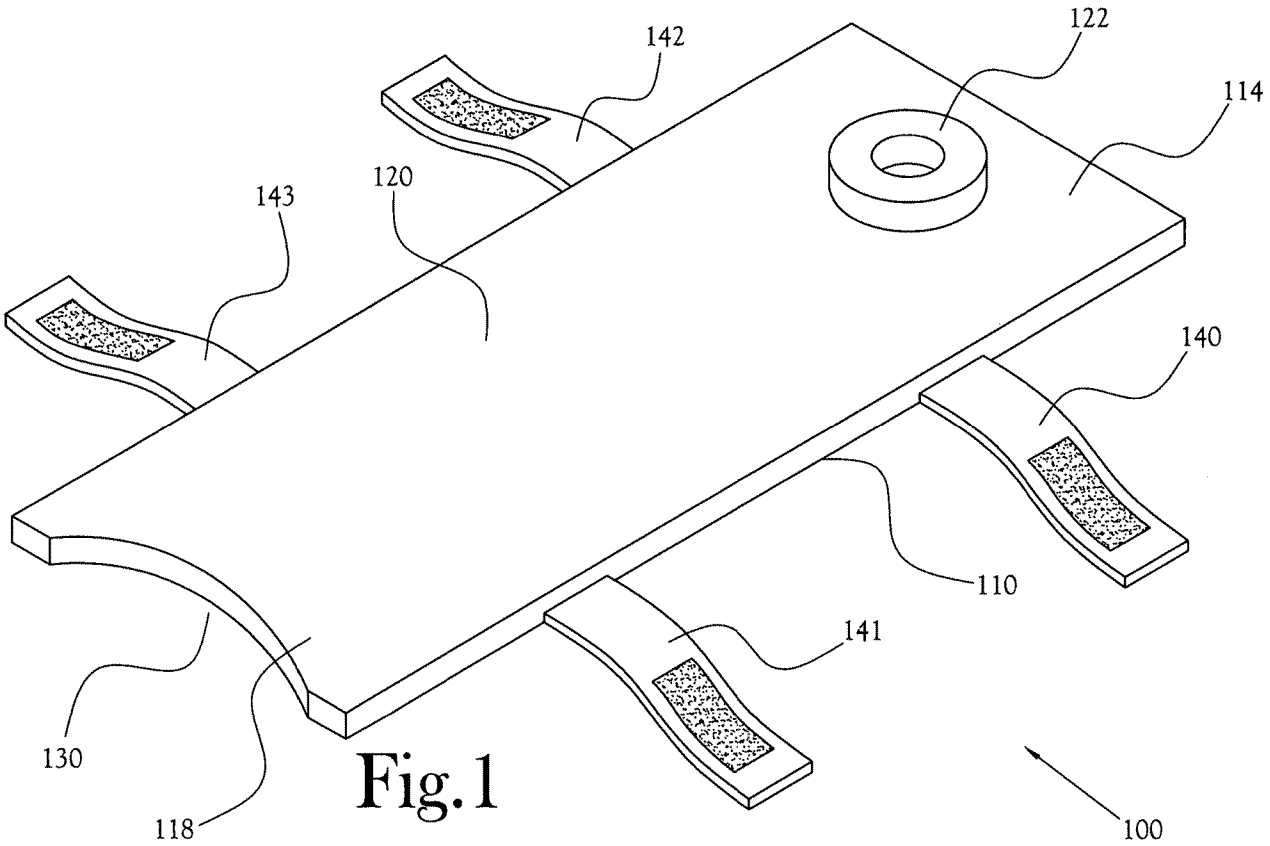
FIG. 1 illustrates a table pad according to an example embodiment of the present general inventive concept.
Figure 2:
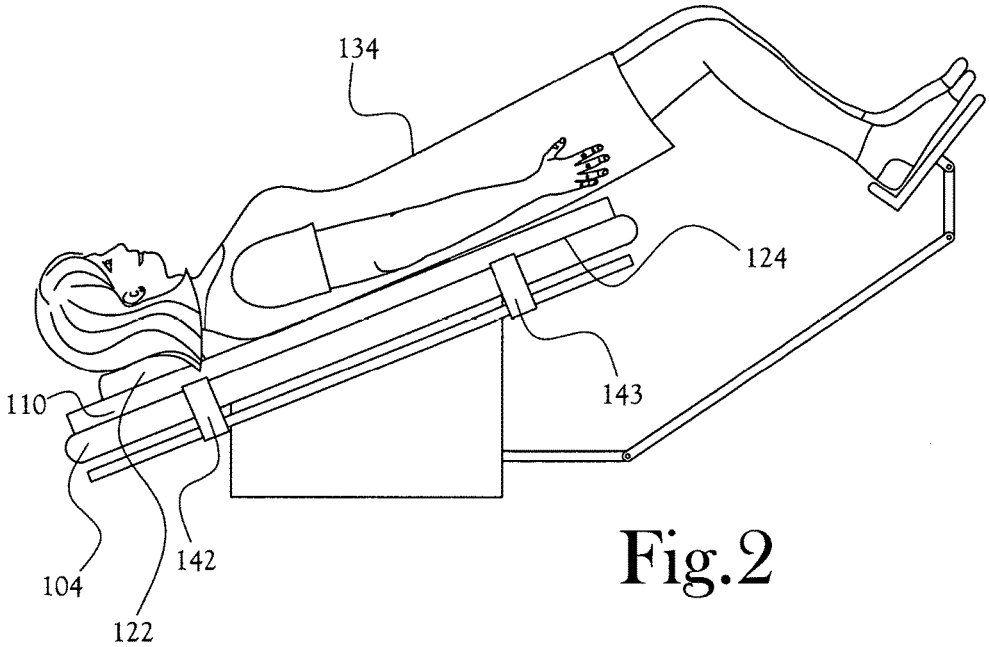
FIG. 2 illustrates an example use of the table pad of FIG. 1.

FIG. 1 illustrates a table pad according to an example embodiment of the present general inventive concept, and FIG. 2 illustrates an example use of the table pad of FIG. 1. It is noted that the term "table pad" may be used interchangeably herein with similar terms such as operating table pad, surgical pad, or simply pad. The table pad 110 is configured to be used in any of a number of various medical procedures.

The example embodiment of the table pad 110 illustrated in FIG. 1, which may be included in or referred to as a surface pad system 100, may be supported by a substantially upward-facing table-top such as a surgical table 104, which may be interchangeably referred to herein as an operating room table, operating table, or simply a table. The table pad 110 of this example embodiment includes a head end 114 (or anterior end), a foot end 118 (or posterior end), a top side 120, and a bottom side 124.

As used in this description, the phrase "head end" will be used to denote the end of any referred-to object that is positioned to lie nearest the head end of a table-top, and the phrase "foot end" will be used to denote the end of any referred-to object that is positioned to lie nearest the foot end of table-top. Likewise, the phrase "top side" or "top surface" will be used to denote the side of the table pad 110 a patient lies on, and the phrase "bottom side" or "bottom surface" will be used to denote the side of the table pad 110 lying on the table-top. The pad may be used to provide comfort to a patient 134 when the patient is supported by the surgical table 104, to prevent sliding on the surgical table 104, and so forth.

In various example embodiments the table pad 110 may be turned over or flipped so that the top and bottom are interchangeable to provide extended use out of a single pad. In various example embodiments, a head resting portion 122, such as any of a host of types of pillows, may be provided proximate the head end 114 of the table pad 110.

The head resting portion 122 may be coupled to the table pad 110 by a number of methods, such as adhesive, or may be integrally formed with the table pad 110. In various example embodiments, the head resting portion 122 may be readily detachable such that both sides of the table pad 110 may be interchangeably used as the top side 120.

Various example embodiments of the present general inventive concept provide a table pad that includes a pressure-reduction foam made from foam rubber and including a thermally active "visco-elastic" foam rubber material. Various example embodiments of the present general inventive concept may provide various different amounts of the thermally active visco-elastic foam rubber material. When the foam rubber included in the table pad is at a warmer temperature the foam is softer and more pliable, and when the foam layer is at a cooler temperature the foam is harder and retains its shape but may tend to conform to the shape of the patient.

Various example embodiments of the present general inventive concept include a perineal cut-out, or recess portion, 130 that may be useful to permit access to the patient's perineum when the patient is lying on the foam pad, for example in the supine position, and/or in procedures that require Trendelenburg positioning.

The cut-out 130 may be utilized for procedures such as exposing a patient's perineum (i.e., the region between the pubic symphysis and the coccyx). As illustrated in the example embodiment of FIG. 1, the cut-out 130 may be semi-circular with a circular diameter of on the order of 70% of the width of the pad. The radius, or the depth of the circle radius into the end of the pad may be on the order of 35% of the width of the pad. The table pad 110 may be configured to provide sacral contact, or contact with the sacrum, and may be configured to prevent contact between the patient and the table. In various example embodiments, the table pad 110 may have a generally straight shape as illustrated by line 200.

In the Trendelenburg position a patient is typically laid flat on the back (supine position) with the feet higher than the head, approximately 15-30 degrees from horizontal. According to various example embodiments of the present general inventive concept, the cut-out 130 may be any of a number of types of recess from the otherwise substantially straight edge of the foot-end 118. In the example embodiment illustrated in FIG. 1, the cut-out 130 is configured as an arc having endpoints that are offset from the corners of the edge of the foot-end 118. In other example embodiments, the cut-out 130 may be have larger or smaller widths, depths, and/or configurations, such as having end points proximate to the corners of the table pad 110, or having a less arcuate configuration that may be deeper but have a smaller width.

According to various example embodiments of the present general inventive concept, and as illustrated in FIG. 1, one or more optional securing straps 140-143 may be provided to the pad on the bottom or top side, or emanating from the edges of the table pad 110. The straps 140-143 may be utilized to assist in holding the table pad 110 stationary when the straps 140-143 are wrapped around and secured to a part of the surgical table 104, such as the safety rails of the surgical table 104.

Figure 3:
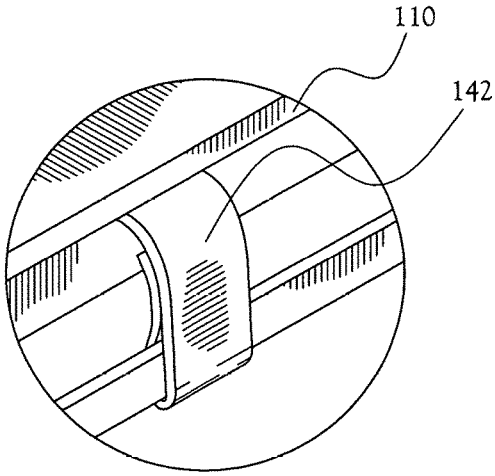
FIG. 3 illustrates a magnified view of a strap of the table pad of FIG. 2 being used to secure the table pad to a surgical table according to an example embodiment of the present general inventive concept.

FIG. 3 illustrates a magnified view of one of the optional straps 140-143 of the table pad 110 of FIG. 2 being used to secure the table pad 110 to the surgical table 104 according to an example embodiment of the present general inventive concept. According to various example embodiments, the securing of the straps 140-143 may be accomplished by any number of configurations/methods, such as utilizing hook-and-loop fabric fasteners and may include two components such as two lineal fabric strips (or, alternatively, round "dots" or squares) which are attached (e.g., sewn, adhered, etc.) to the opposing surfaces to be fastened. In an example embodiment, the first component may feature tiny hooks, and the second component may feature loops. When the two components are pressed together, the hooks catch in the loops and the two pieces fasten or bind temporarily. Separation may be by pulling or peeling the two strips apart. The straps 140-143 may be coupled to the table pad 110 in any of a host of configurations, such as, for example, utilizing an adhesive, being formed integrally with the table pad 110, and so on. In other various example embodiments, the straps 140-143 may be available to optionally add to the table pad 110, such as by hook and loop adhesion points, or by threading through a slit provided in the table pad 110, and so on. The optional straps 140-143 may be utilized for pad immobilization during patient transfer or interoperative procedural use, but it is understood the composition of the pad typically does not require any straps for pad immobilization.

In various example embodiments, the table 110 pad may be approximately 1 inch thick or more, and may have no foam "memory". For example, it is possible to roll-up the pad for shipping and/or storage convenience, and then unroll the pad for use, where the pad is capable of lying flat on the table surface without portions of the pad having a tendency to lift-off the table surface due to memory from the rolled-up position.

In various example embodiments, the pad may include an expanded cellular product such as a flame retardant polyurethane foam. The density may be considered a high density foam on the order of 3.6 to 3.9 lbs/ft3 with a Differential Pressure Air Permeability (ASTM D3574 test) of on the order of approximately 7 to 13.

The surgical pad may be a gel-infused polyurethane or visco-elastic foam. Such a foam is designed to absorb and distribute pressure from a patient. It also provides support which may evenly distribute body weight and provide long lasting durability. It may wick away body heat to aid in consistent sleep temperature, provide stability, and reduce motion transfer.

When a patient lies down, the table pad 110 (having infused gel therein) may be depressed from downwardly projecting portions of the patient that result in high interface pressure points between the patient and patient-support surface. This movement away from high interface pressure points and toward lower pressure interface points operates to increase the surface area of contact between the patient and table to minimize the interface pressure at high interface pressure points between the patient and patient-support surface. Maximizing the surface area of contact between the patient and patient-support surface also maximizes the conductive heat transfer between the patient and patient-support surface. Although various example embodiments of the present general inventive concept have been described as being used in Trendelenburg positioning, it is understood that various features of the present general inventive concept are valuable in a number of other positions and/or procedures.

Figure 4A:
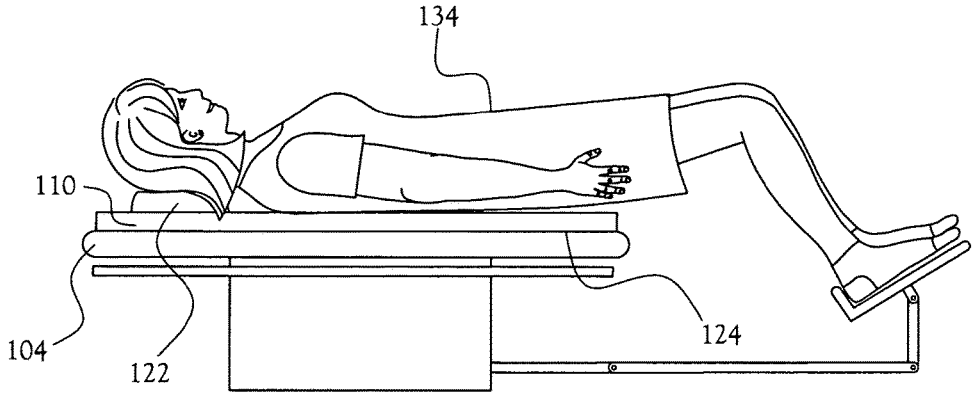
FIGS. 4A-4B illustrate two other example uses of the table pad of FIG. 2.
Figure 4B:
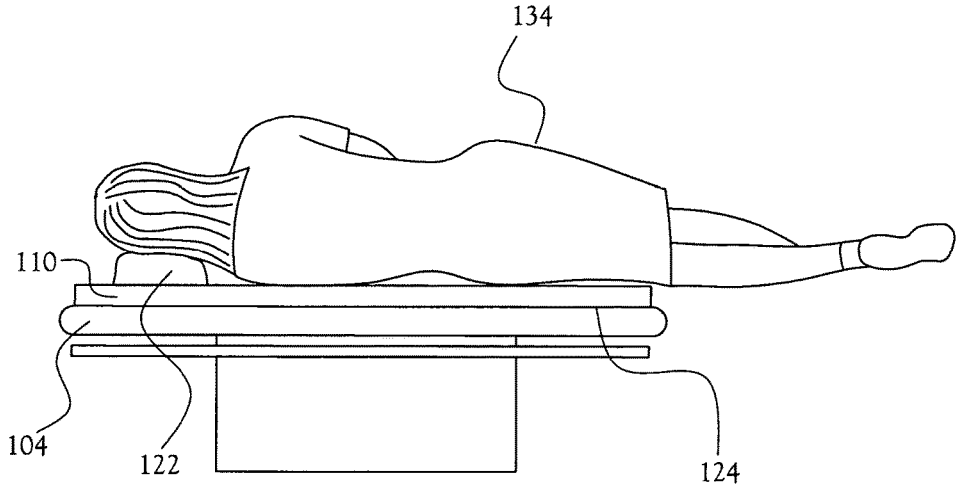

FIGS. 4A-4B illustrate example uses of the table pad 110 of FIG. 2. FIG. 4A illustrates a patient in the supine position, with feet in stirrups, but being positioned in a substantially horizontal position, and FIG. 4B illustrates a patient on her side in a substantially horizontal position. These figures illustrate merely two example patient positions which may can be utilized with the table pad 110 of the present general inventive concept, but the present table pad 110 is not limited to any particular patient size or position to provide increased comfort, weight distribution, and reduced sliding on a surgical table.

Figure 5:
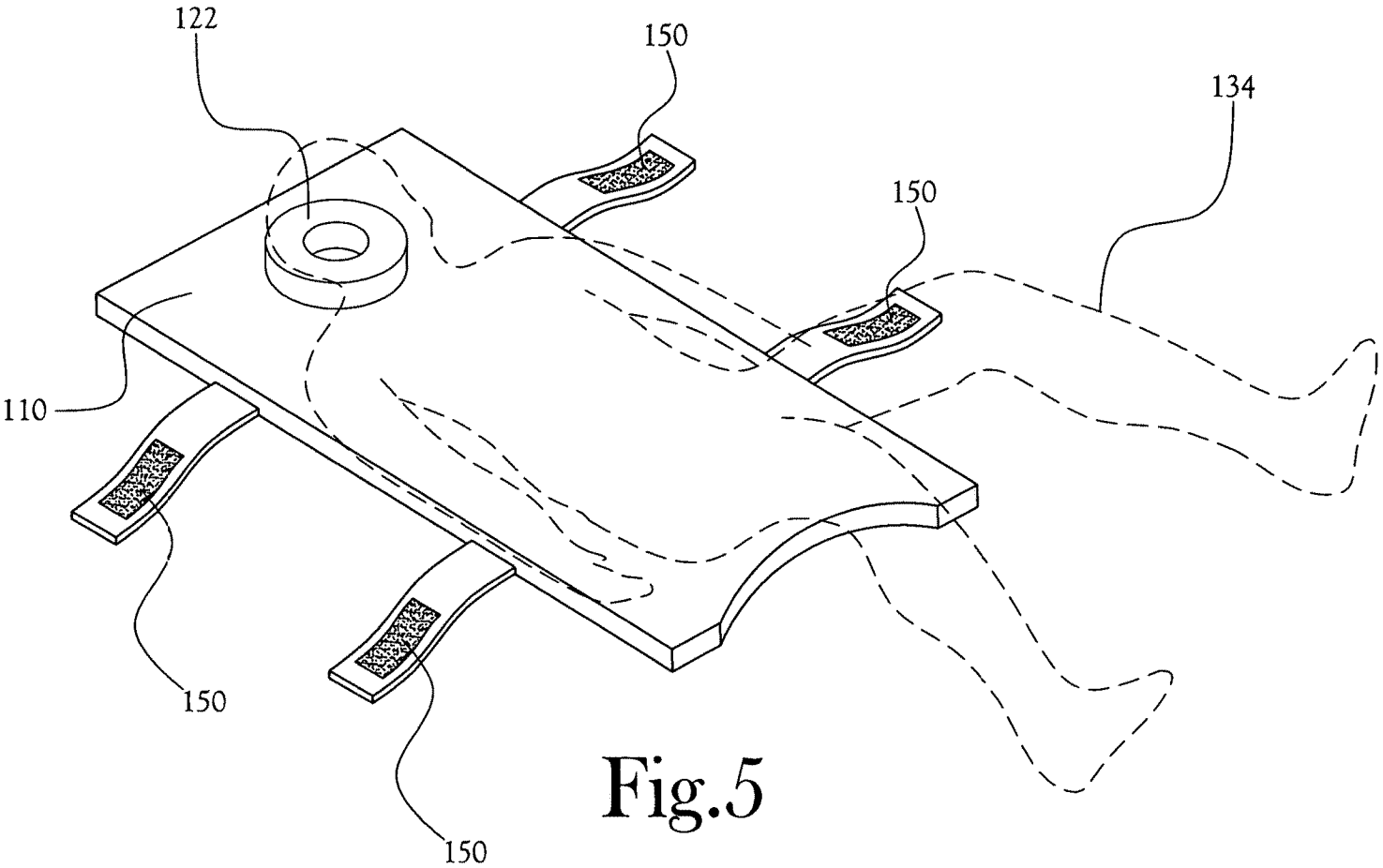
FIG. 5 illustrates an example positioning of a patient on the table pad of FIG. 1.

FIG. 5 illustrates an example positioning of a patient on the table pad of FIG. 1 in an outline manner to better see the positioning of the various areas of the patient relative to the parts of the table pad 110. The positioning of the patient in FIG. 5 is similar to the Trendelenburg positioning, and shows the cut-out 130 as providing improved access to the perineal region of the patient. In the example embodiment illustrated in FIG. 5, the straps 140-143 have been provided with a hook and loop fastening portion 150 to secure the table pad 110 to the surgical table 104.

Use of a surface pad system 100 such as the one illustrated in FIG. 1 may minimize the interface pressure of the high interface pressure points between the patient and patient-support surface, such as the surgical table 104. The weight of a patient supported on a conventional surface cover for a surgical table 104 is supported primarily by the head, shoulder blades and sacrum. The above-noted portions of the patient are the downwardly extending extremities of the patient when resting on a conventional surface cover for a surgical table 104 and, as a result, these extremities of the patient support most of the weight of the patient and experience the highest interface pressure between the patient and patient-support surface. It can also be seen that several portions of the patient have low interface pressures against patient-support surface and even no contact with patient-support surface. Use of a surface pad system 100 according to various example embodiments of the present general inventive concept may minimize pressure ulcers, neuropathy, and/or other nerve disorders and damage to nerve bundles that my result from prolonged exposure to high interface pressures.

In various example embodiments of the present general inventive concept, the table pad 110 may include a gel-infused, heat wicking foam pad that evenly distributes patient body weight along the table pad 110 to provide support and stability, wherein the composition may substantially prevent motion transfer. Such a property may be advantageous, for example, in steep Trendelenburg positioning.

In various example embodiments the table pad 110 may be a thermally active shock absorbing polyurethane visco-elastic foam. Visco-elastic foam may be formulated so that the firmness and support characteristics of the foam may maintain a generally constant durometer hardness and which provides the same support and firmness characteristics at different operating temperatures. The table pad 110 may easily conform to the shape of the patient carried on the table surface even if the position of the patient is temporarily changed. In various example embodiments, the table pad 110 may be formed from a unitary foam piece, or from a plurality of sections, such as foam blocks.

In various example embodiments, the table pad 110 may be made from a thermally active shock absorbing polyurethane foam that is formulated as a visco-elastic foam. Thus, the support and firmness characteristics of the foam pad may easily conform to the shape of the patient carried on the table.

In various example embodiments of the present general inventive concept, the table pad 110 may be formed of or include a low-impedance material to provide a low impedance path to conduct electric current between the patient and a patient return electrode during electrosurgical procedures. For purposes of the present disclosure, the term "patient return electrode" refers to a pad style that lays flat on a surgical table and provides maximum patient contact without adhesives, rather than other styles of patient return electrodes that may be smaller and use adhesives to remain in contact with the patient. Such electrosurgical systems typically provide an electrosurgical device to deliver an application of a high-frequency electric current to biological tissue as a means to cut, coagulate, dessicate, or fulgurate tissue. During these procedures, the table pad 110 may be interposed between the patient return electrode create reduced, and, in various example embodiments, approaching minimal, impedance during the "cut" mode of electrocautery pens used to stop bleeding at a surgical site. Because of such a feature, the table pad 110 offers enhanced electrocatutery compatibility along with patient safety and the convenience of disposable pads.

Figure 6:
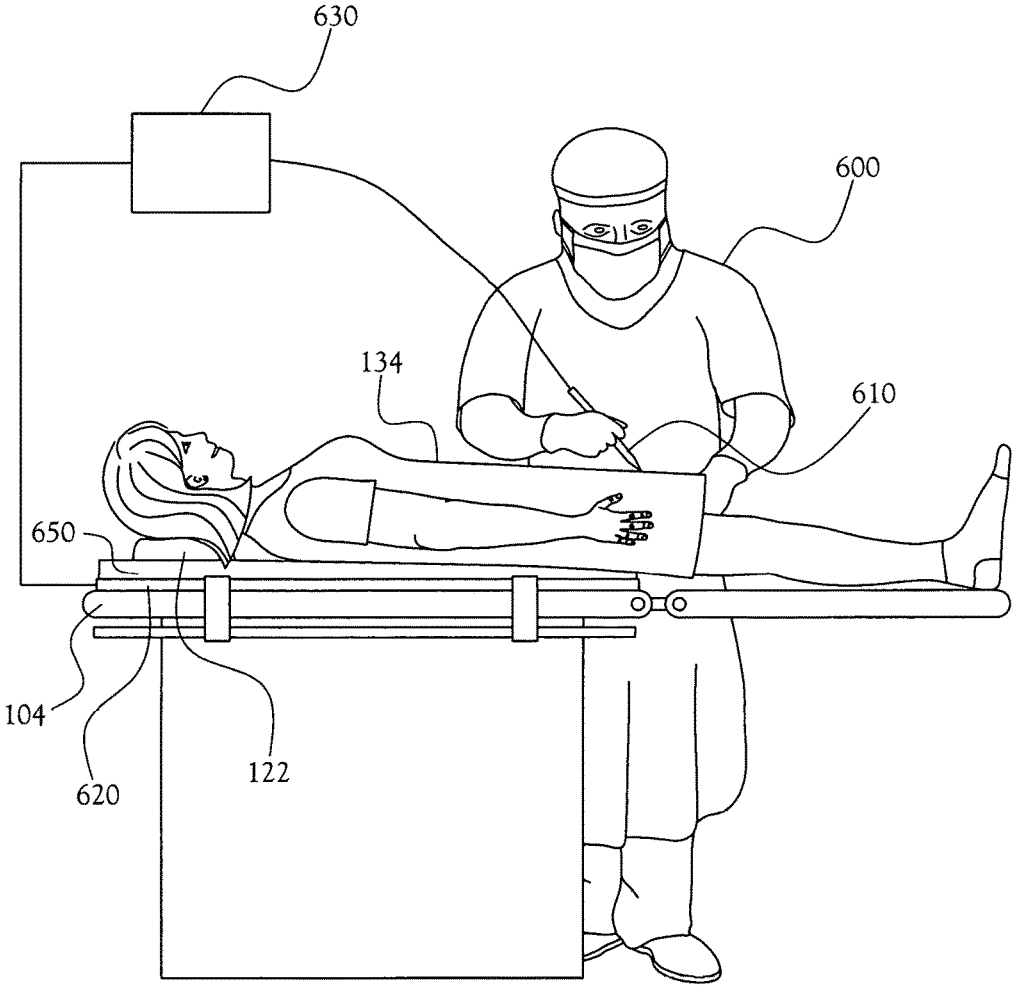
FIG. 6 illustrates an example use of a table pad according to another example embodiment of the present general inventive concept.

FIG. 6 illustrates an example use of a table pad according to the example embodiment of the present general inventive concept in which the table pad 650 includes a low-impedance material such as, for example, an infused gel. In FIG. 6, a surgeon 600 is performing an electrosurgical procedure using an electrocautery pen 610, from which a current moves to a patient return electrode 620, and the low-impedance and resilient table pad 650 is located between the patient 134 and the patient return electrode 610. The electrocautery pen 610 and the patient return electrode 620 are in electrical communication with a power source 630 which provides power to the electrocautery pen 610. As illustrated in FIG. 6, the table pad 650 provides comfort and slide-reducing properties, and also a low-impedance to provide minimal interference with the electrosurgery being performed.

Regarding the ability to provide disposable low-impedance table pads, the use of lithotomy steep Tredelenburg (LST) positioning has increased in recent times due to enhancements in robotic procedures. Such positioning takes careful planning and consideration to protect the patient from sliding or developing shearing type skin injuries. According to AORN Recommended Practices on Positioning the Patient, "measures should be taken to prevent patient from sliding on the procedural bed. Risk for shear injuries increase when changing the patient's position from supine to Trendelenburg and to prevent injury to the shoulders, shoulder braces should be avoided." Thus, the table pad 110 formed of low impedance material according to various examples of the present general inventive concept may minimize patient movement during LST procedures, as well as providing reduced interference with a current between electocauteral pens and a patient return electrode. Conventional positioners that are too thick may decrease the electrosurgical current and result in poor coupling between the patient and the patient return electrode. And, when LST positioning is required, it is important to stabilize the patient return electrode and use it in conjunction with other anti-slide materials, such as the table pad 110, in order to achieve the best outcome.

In one example use of the low-impedance table pad 110 of the present general inventive concept, the patient return electrode may be placed against the surgical table 104 without sheets or other materials. A patient safety strap or a surgical towel with adhesive tape may be used to secure the patient return electrode to the table. The table pad 110 may be placed on top of the patient return electrode, in some cases without sheets or other materials (or, in some cases, with a single folded sheet for tucking the patient's arms). The straps 140-143 may be secured to the metal railing of the surgical table 104 securely against the bolted anchors to prevent pad movement during positioning. The patient may then be laid on the table pad 110 without sheets or gowns between the patient and the table pad 110. The use of sheets between the patient and the patient return electrode, such as lift sheets, may be undesirable due to the added impedance which would reduce the conductivity of electric current flowing from the patient to the patient return electrode and reduce effectiveness of the electrosurgery procedure.

The patient may be monitored during positioning and intraoperatively to assess for patient movement, so that the table pad 110 may be adjusted if necessary. The materials of which the table pad 110 is constructed according to various example embodiments of the present general inventive concept aid in the prevention of slipping or other movement of the patient relative to the surgical table 104 and/or the patient return electrode, and have the added convenience of being disposable, as well as reducing pressure points to make the patient more comfortable.

Figure 7:
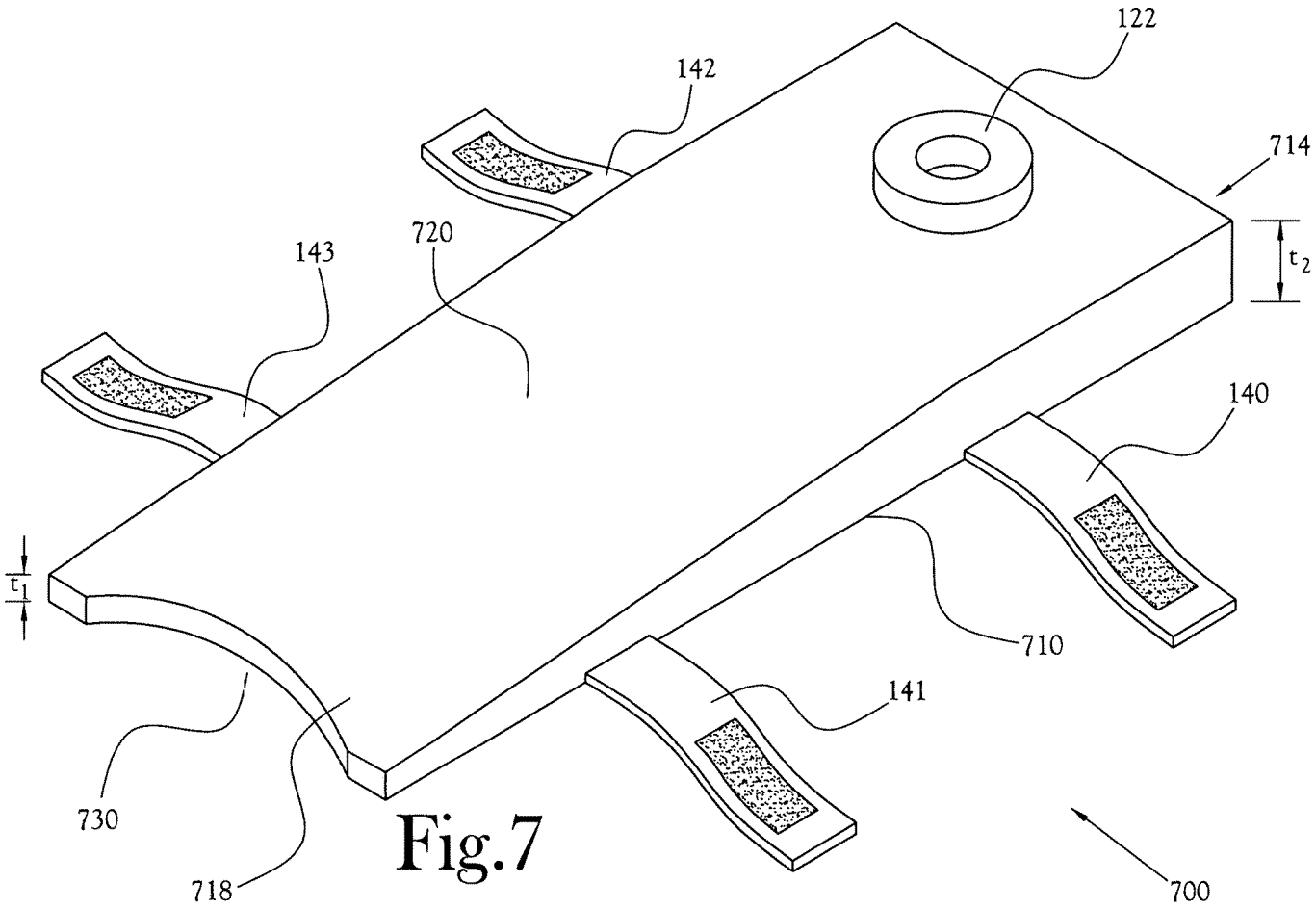
FIG. 7 illustrates an example embodiment of the present general inventive concept, showing a sloping or tapered surgical pad.
Figure 8:
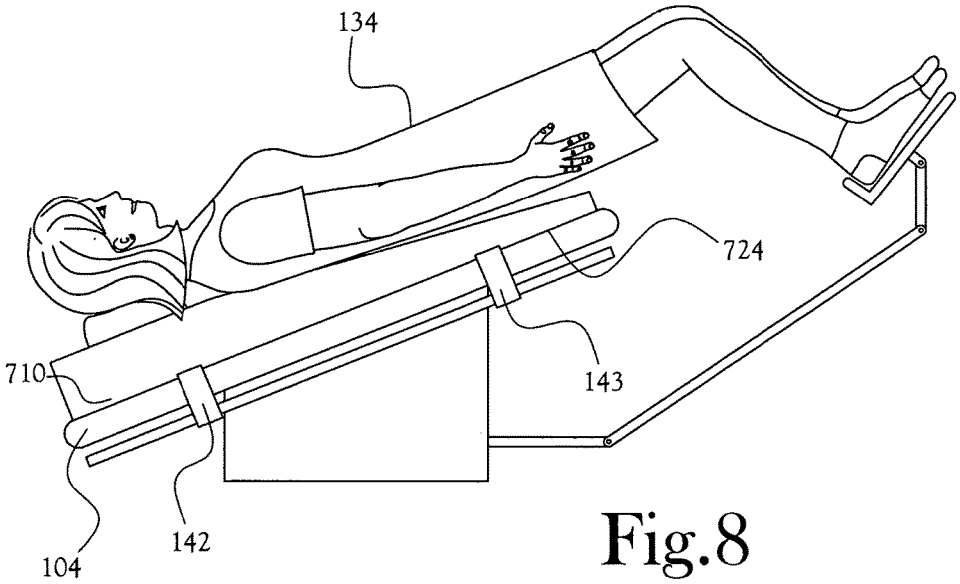
FIG. 8 illustrates an example use of the sloping or tapered surgical pad of FIG. 7.
Figure 9:
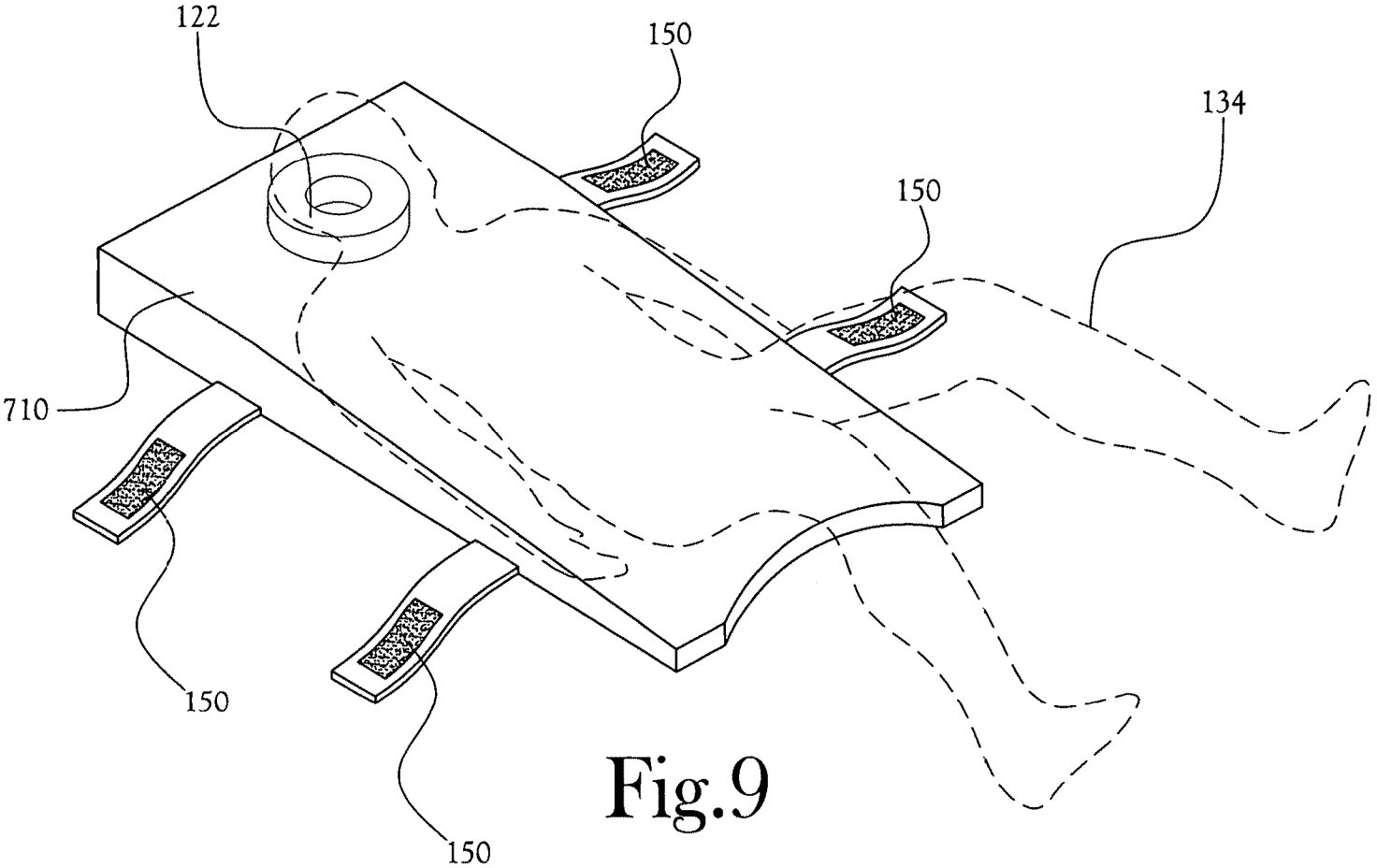
FIG. 9 illustrates an example positioning of a patient on the sloping or tapered surgical pad of FIG. 7.

FIG. 7 illustrates a sloping or tapered table pad 710 according to another example embodiment of the present general inventive concept; FIGS. 8 and 9 illustrate example uses of the table pad of FIG. 7. It is noted that the term "table pad" may be used interchangeably herein with similar terms such as operating table pad, surgical pad, or simply pad. The table pad 710 is configured to be used in any of a number of various medical procedures. The example embodiment of the table pad 710 illustrated in FIG. 7, which may be included in or referred to as a surface pad system 700, may be supported by a substantially upward-facing table-top such as a surgical table 104, which may be interchangeably referred to herein as an operating room table, operating table, or simply a table.

The table pad 710 of this illustrated example embodiment includes a back surface 714 (or head end or anterior end), a front surface 718 (or foot end or posterior end), a top surface 720, and a bottom surface 724. The front surface 718 defines a first thickness t1, and the back surface 714 defines a second thickness t2. The front surface 718 and the back surface 714 are substantially perpendicular to the bottom surface 724. The top surface 720 defines a plane that tapers from the second thickness to the first thickness, such that the angle between the plane defined by the top surface 720 and the plane defined by the back surface 714 is an acute angle, and the angle between the plane defined by the top surface 720 and the plane defined by the front surface 718 is an obtuse angle.

The sloping or tapered table pad 710 presents advantages for reducing slippage by the patient when the patient is on the table pad 710. In addition to the support and firmness characteristics of the foam pad which easily conforms to the shape of the patient carried on the table to hold the patient in position when the operating room table is inclined in the Trendelenburg position, the sloping or tapered shape of the pad 710 i.e., where the thickness at the foot end is less than the thickness at the head end facilitates increased conformity and support of the foam around the upper bodily portions such as the shoulders and upper back, thus providing additional holding forces for the body against gravity in the Trendelenburg position compared to a traditional flat pad. Furthermore, the relatively thinner foot portion facilitates uninhibited access to the patient's perineal portion for the surgeon as the reduced thickness of the pad at the foot end compresses to a thinner thickness relative to the head end so as not to obstruct the surgeon's access to the perineal area of the patient.

In some embodiments, the surgical pad can include a gel-infused polyurethane visco-elastic foam configured to support a patient on an operating room table, wherein the foam is configured to have substantially no memory such that when the surgical pad is rolled-up for shipping and/or storage, the surgical pad returns to a flat shape immediately upon being unrolled, and a perineal cut-out to permit access to the patient's perineum when the patient is lying in a supine position on the surgical pad.

These features can be achieved with a foam configured to have a density of approximately 3.6 to 3.9 lbs/ft3 and a Differential Pressure Air Permeability between 7 and 13. The air density of the foam can be constructed to wick away body heat and reduce motion transfer. The foam can be configured as thermally active shock-absorbing foam.

The perineal cut-out can be approximately semi-circular in shape. The perineal cut-out can define an arc less than 180 degrees in circumference, where the end points of the arc intersect an end surface of the surgical pad in two locations to respectively define a pair of equidistant flats extending between the end points and opposing side edges of the surgical pad, respectively.

The surgical pad can include at least one strap configured to secure the surgical pad to the operating room table. The surgical pad can include a head receiving portion proximate an anterior end of the surgical pad.

Example embodiments of the present general inventive concept can be achieved by providing a method of using a surgical pad, where the surgical pad has been rolled into a substantially cylindrical article for storage or transportation. The method can include unrolling the surgical pad on an operating room table such that the surgical pad supports a patient in the Trendelenburg position. The surgical pad can be manufactured of a gel-infused polyurethane visco-elastic foam having substantially no memory such that the surgical pad assumes a flat shape on top of the operating room table immediately upon being unrolled from a stored, substantially cylindrical shape, the cylindrical shape being defined when the surgical pad is rolled upon itself from end-to-end on to form a substantially cylindrical article during storage of the surgical pad. The surgical pad can include a perineal cut-out to permit access to the patient's perineum when the patient is lying on the surgical pad in the Trendelenburg position.

The method can include one more of rolling the surgical pad into a cylindrical shape to store the surgical pad on a shelf, unrolling the surgical pad on an operating room table such that the surgical pad is oriented to support a patient in the Trendelenburg position wherein the surgical pad assumes a flat shape on top of the operating room table immediately upon being unrolled from a stored, placing a patient on top of the surgical pad such that a perineal cut-out of the surgical pad permits access to the patient's perineum by a surgical worker when the patient is lying on the surgical pad in the Trendelenburg position.

The surgical pad can include a top surface and a bottom surface such than when the surgical pad is rolled into a cylindrical shape, a substantial portion of the top surface contacts a substantial portion of the bottom surface.

The density of the foam can be approximately 3.6 to 3.9 lbs/ft3, and the Differential Pressure Air Permeability can be between 7 and 13.

The foam can be configured to wick away body heat, which aids in consistent sleep temperature, stability, and reduced motion transfer of the patient.

In the illustrated example embodiment, the table pad 710 encompasses a foam pad (or foam body) including gel-infused polyurethane visco-elastic foam; this foam pad is configured to support a patient on an operating room table.

The foam body can be designed to have a first thickness at a first end and a second thickness at a second end where the first thickness is less than the second thickness. A perineal cut-out can be provided at the first end to define an arcuate shape extending through the first thickness to permit access to the patient's perineum when the patient is lying in a supine position on the foam body. The foam body can be formed of gel-infused polyurethane visco-elastic foam. The foam can have a density of approximately 3.6 to 3.9 lbs/ft3, and the gel-infused polyurethane visco-elastic foam can include flame retardant polyurethane foam.

The perineal cut-out can define an arc less than 180 degrees in circumference, where the end points of the arc intersect the first surface in two locations to respectively define a pair of equidistant flats extending between the end points and opposing side edges of the foam body, respectively.

The foam body can have a thickness at the second end between 2 inches and 4 inches and a thickness at the first end of less than 2 inches. The greater thickness at the head end provides additional conformity and support for the body, while the thinner thickness at the foot end provides unfettered access to the patient' perineal area due to the thinner foam structure at the foot end. In some embodiments, the foam body can have a thickness at the second end between 2.5 inches and 3.5 inches and a thickness at the first end of less than 1.5 inches, although other thicknesses could be chosen using sound engineering judgement without departing from the broader scope and spirit of the present general inventive concept.

The foam pad can include at least one strap configured to secure the foam body to an operating room table.

The foam pad can be configured to be rolled-up for shipping and/or storage. The sloping shape also enables the foam pad to unroll and return to its original shape immediately upon being unrolled, due to its tapered shape which provides varying degrees of foam memory along the length of the pad when thicker portions are rolled upon with thinner portions, facilitating self-unrolling properties when thinner portions are unrolled against thicker portions.

The foam pad can be configured to support a patient on an operating room table, the foam pad having a front surface, a back surface, a planar top surface, and a planar bottom surface, wherein the front surface defines a first thickness and the back surface defines a second thickness greater than the first thickness, the front surface and the back surface being substantially perpendicular to the bottom surface, and the top surface defining a first plane extending between the second thickness to the first thickness such that an angle between the first plane and a second plane defined by the back surface is an acute angle, and the angle between the first plane and the front surface is an obtuse angle, and a perineal cut-out at the front surface defining an arcuate shape extending through the front surface to permit access to the patient's perineum when the patient is lying in a supine position on the foam pad.

The perineal cut-out can define an arc less than 180 degrees in circumference, where the end points of the arc intersect the front surface of the surgical pad in two locations to respectively define a pair of equidistant flats extending between the end points and opposing side edges of the foam pad, respectively.

Various example embodiments of the present general inventive concept provide a table pad that includes a pressure-reduction foam made from foam rubber and including a thermally active "visco-elastic" foam rubber material. Various example embodiments of the present general inventive concept may provide various different amounts of the thermally active visco-elastic foam rubber material. When the foam rubber included in the table pad is at a warmer temperature the foam is softer and more pliable, and when the foam layer is at a cooler temperature the foam is harder and retains its shape but may tend to conform to the shape of the patient.

Various example embodiments of the present general inventive concept include a perineal cut-out, or recess portion, 730 that may be useful to permit access to the patient's perineum when the patient is lying on the foam pad, for example in the supine position, and/or in procedures that require Trendelenburg positioning. The cut-out 730 may be utilized for procedures such as exposing a patient's perineum (i.e., the region between the pubic symphysis and the coccyx). As illustrated in the example embodiment of FIG. 7, the cut-out 730 may be semi-circular with a circular diameter of on the order of 70% of the width of the pad. The radius, or the depth of the circle radius into the end of the pad may be on the order of 35% of the width of the pad. The table pad 710 may be configured to provide sacral contact, or contact with the sacrum, and may be configured to prevent contact between the patient and the table.

In the Trendelenburg position a patient is typically laid flat on the back (supine position) with the feet higher than the head, approximately 15-30 degrees from horizontal. According to various example embodiments of the present general inventive concept, the cut-out 730 may be any of a number of types of recess from the otherwise substantially straight front surface 718. In the example embodiment illustrated in FIG. 7, the cut-out 730 is configured as an arc having endpoints that are offset from the corners of the edge of the front surface 718. In other example embodiments, the cut-out 730 may be have larger or smaller widths, depths, and/or configurations, such as having end points proximate to the corners of the table pad 710, or having a less arcuate configuration that may be deeper but have a smaller width.

According to various example embodiments of the present general inventive concept, and as illustrated in FIG. 7, one or more optional securing straps 140-143 may be provided to the pad on the bottom or top side, or emanating from the edges of the table pad 710. The straps 140-143 may be utilized to assist in holding the table pad 110 stationary when the straps 140-143 are wrapped around and secured to a part of the surgical table 104, such as the safety rails of the surgical table 104.

It is noted that the simplified diagrams and drawings do not illustrate all the various connections and assemblies of the various components, however, those skilled in the art will understand how to implement such connections and assemblies, based on the illustrated components, figures, and descriptions provided herein, using sound engineering judgment.

Example embodiments of the present general inventive concept may be achieved by methods of making a surgical pad including providing a surgical pad including a foam pad configured to support a patient on an operating room table, the foam pad comprising a gel-infused polyurethane visco-elastic foam.

The method may include infusing a polyurethane visco-elastic foam with gel such that the foam has substantially no memory to operate such that when the surgical pad is rolled-up for shipping and/or storage, the surgical pad returns to a flat shape immediately upon being unrolled, and providing a perineal cut-out to permit access to the patient's perineum when the patient is lying in a supine position on the surgical pad.

The foam pad may include a perineal cut-out to permit access to the patient's perineum when the patient is lying in a supine position on the foam pad.

The surgical pad may further include at least one strap configured to secure the foam pad to the table.

The foam pad may have a density of approximately 3.6 to 3.9 lbs/ft3.

The perineal cut-out may be approximately semi-circular in shape.

The cut-out may define an arc less than 180 degrees in circumference, the end points of the arc intersecting an end surface of the surgical pad in two locations to respectively define a pair of equidistant flats extending between the end points and side edges of the surgical pad, respectively.

Example embodiments of the present general inventive concept may also be achieved by providing a surgical pad for use in an electrosurgical system, the electrosurgical system including an electrosurgical device to deliver an electric current to a patient during an electrosurgical procedure, and a patient return electrode to return the electric current from the patient to the electrosurgical device when the patient is lying on the patient return electrode, the surgical pad comprising gel-infused material, the surgical pad being configured to be interposed between the patient return electrode and the patient during an electrosurgical procedure to create a low impedance path to conduct electric current from the patient to the patient return electrode during the electrosurgical procedure.

The surgical pad may be configured to be placed on the patient return electrode on a surgical procedure table to support the patient on the surgical procedure table in a steep Trendelenburg position.

The surgical pad may include an expanded cellular product including flame retardant polyurethane foam.

The surgical pad may further include a head receiving portion proximate an anterior end of the surgical pad.

The surgical pad may further include a recessed portion at a posterior end of the surgical pad that is configured to allow access to the patient's perineum when the patient is in a supine position.

The recessed portion may be arcuate and substantially centered on a width of the surgical pad.

The recessed portion may have end-points intersecting the posterior end of the surgical pad to define a pair of flat portions that extend from the end-points to respective corners of the posterior end.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, it is not the intention of the applicant to restrict or in any way limit the scope of the inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

The invention claimed is:

1. A method of using a surgical pad that has been rolled into a substantially cylindrical article for storage or transportation of the surgical pad, comprising:

unrolling the surgical pad on an operating room table such that the surgical pad is oriented to support a patient in the Trendelenburg position during surgery the surgical pad being configured of a gel-infused polyurethane visco-elastic foam having substantially low memory such that the surgical pad assumes a flat shape on top of the operating room table immediately upon being unrolled from a stored, substantially cylindrical shape where the surgical pad has been rolled upon itself from end-to-end on to form the substantially cylindrical article during storage of the surgical pad, the surgical pad including a perineal cut-out at a posterior end thereof to permit access to the patient's perineum when the patient is lying on the surgical pad in the Trendelenburg position.

2. The method of claim 1, wherein the surgical pad includes a top surface and a bottom surface and wherein after rolling a substantial portion of the top surface contacts a substantial portion of the bottom surface.

3. The method of claim 1, wherein the surgical pad has a density of approximately 3.6 to 3.9 lbs/ft$^3$.

4. The method of claim 3, wherein the foam is configured to wick away body heat to aid in consistent sleep temperature, stability, and reduced motion transfer of the patient.

5. The method of claim 1, wherein the surgical pad tapers from a first thickness at an anterior end to a second thickness at the posterior end.

* * * * *